US005709111A

United States Patent [19]

Henao

[11] Patent Number: 5,709,111

[45] Date of Patent: Jan. 20, 1998

[54] LOCK SYSTEM

[76] Inventor: Jose Gabriel Henao, 8880 SW. 6th La., Miami, Fla. 33174

[21] Appl. No.: 565,956

[22] Filed: Dec. 4, 1995

[51] Int. Cl.[6] ..... E05B 63/00

[52] U.S. Cl. ..... 70/104; 70/118; 70/120

[58] Field of Search ..... 70/103, 104, 106, 70/113, 118, 120, DIG. 42; 292/39

[56] References Cited

U.S. PATENT DOCUMENTS

| | | | |
|---|---|---|---|
| 97,581 | 12/1869 | Worrell et al. | 70/118 |
| 184,680 | 11/1876 | Whitson et al. | 70/120 |
| 430,072 | 6/1890 | Dowd | 70/118 |
| 1,195,594 | 8/1916 | Kohut | 292/39 |
| 1,398,159 | 11/1921 | Sontow | 70/118 |
| 1,536,773 | 5/1925 | Ciaccio | 70/118 |
| 2,066,705 | 1/1937 | Vazquez | 70/118 |
| 2,125,227 | 7/1938 | Hammarle | 70/118 |
| 2,167,875 | 8/1939 | Cornell et al. | 70/118 |
| 2,261,353 | 11/1941 | Fedele | 70/120 |
| 2,752,445 | 6/1956 | Navarrete | 70/120 |
| 2,787,154 | 4/1957 | Wesberry | 70/118 |
| 2,946,214 | 7/1960 | Gotay | 292/39 |
| 3,062,003 | 11/1962 | Schmalfeldt | 70/DIG. 42 X |
| 3,792,885 | 2/1974 | Giardina et al. | 292/39 |
| 4,432,573 | 2/1984 | Goldman | 292/37 |
| 5,094,483 | 3/1992 | James | 292/39 |
| 5,245,846 | 9/1993 | James | 70/118 |

FOREIGN PATENT DOCUMENTS

| | | | |
|---|---|---|---|
| 35230 | 11/1928 | Germany | 70/118 |

*Primary Examiner*—Steven N. Meyers
*Assistant Examiner*—Donald J. Lecher
*Attorney, Agent, or Firm*—Malloy & Malloy, P.A.

[57] ABSTRACT

An improved lock system structured to secure a structure closure in a closed position, the lock system including a main housing with a surrounding wall structure, an open interior and opposing outlet ends, and a pair of opposing track members disposed within the open interior of the main housing, and each having a first end and a plurality of teeth along an interior surface thereof. The track members are disposed in spaced, confronting relation from one another such that the teeth on the interior surfaces thereof confront one another. Additionally, disposed between the teeth of the track members is a drive member, including a drive segment having a plurality of drive teeth around a perimeter thereof to engage the teeth on the track members, and at least one actuator segment to facilitate exterior rotation of the drive segment resulting in corresponding lateral movement of the track members towards and away from the opposing outlet ends of the main housing. Extending from each of the track members towards the opposing outlet ends are lock members, each including at least one lock shaft structured to protrude from the main housing upon corresponding movement of the track members. Shaft retention housings are disposed adjacent each opposing outlet end of the main housing so as to receive engagement ends of the lock shafts therein and therethrough to prevent planar movement of the main housing relative to the shaft retention housing.

12 Claims, 3 Drawing Sheets

LOCK SYSTEM

BACKGROUND OF THE INVENTION

1. Field of the Invention

The present invention relates to an improved lock system to be utilized primarily at a door or other structure closure so as to provide substantially secure, locked closure thereof through a long-lasting, durable lock system that is easy to install but difficult to tamper with.

2 Description of the Related Art

In the art relating to lock systems, and in particular locks for structural closures, a variety of different, and often complex mechanisms are generally implemented. The primary features that all of these systems have in common, however, is the use of a single, relatively short bolt, which extends into the frame, and an interior lock mechanism which translates a turn of a key or handle into corresponding locking and unlock lateral movement of the bolt portion. These conventional types of locks, however, are often very complicated and difficult to install and are susceptible to wear or malfunction. Further, as they only engage a single side of a door closure, they are susceptible to prying or dislodging by a focused impact at the point of engagement.

Accordingly, there is a substantial need in the art for an affective and secure lock system which can be easily installed either integrally with a structural closure or as an added security measure, and which will thereby substantially prevent prying or breakage. Also, there is a need in the art for a safe and effective lock system which is substantially solid and well contained so as to prevent tampering with the interior workings thereof.

SUMMARY OF THE INVENTION

The present invention is directed towards an improved lock system to be used preferably on a structure closure, such as a door or window. The improved lock system includes primarily a strong, sturdy main housing which includes a surrounding wall structure, an open interior, and opposing outlet ends.

Disposed within the open interior of the main housing are a pair of opposing track members. Each of the opposing track members includes a first end, a second end and a plurality of teeth disposed along an interior surface of each track member. Further, the opposing track members are disposed in spaced, confronting relation from one another within the open interior of the main housing such that their interior surfaces, and accordingly the plurality of gear teeth on the interior surfaces of the track members, confront one another, and such that the first end of each of the track members extends towards a corresponding opposing outlet end of the main housing.

Centrally disposed in the main housing is a drive member. The drive member includes a drive segment and at least one actuator segment. The drive segment is contained in the open interior of the main housing between the confronting interior surfaces of the track members. Further, much like the interior surfaces of the track members, the drive segment includes a plurality of drive teeth disposed about a perimeter thereof. The drive teeth are structured to engage the teeth on the confronting interior surfaces of the track members simultaneously such that upon rotation of the drive segment in a first direction, both track members will move such that the first ends thereof move away from one another and towards the corresponding one of the opposing outlet ends of the main housing. Similarly, upon rotation of the drive segment in a second direction both of the track members move laterally such that the first ends thereof move towards one another and away from the corresponding opposing outlet end of the main housing. Corresponding rotation of the drive segment is achieved utilizing the actuator segment. The actuator segment is disposed to protrude from the main housing through the surrounding side-wall structure so as to be easily handled and turned by a user for the corresponding rotation of the drive segment.

Extending from the first end of each of the track members towards the corresponding opposing outlet end of the main housing is a lock member. Each of the lock members is structured to include at least one lock shaft having an engagement end which is structured to protrude through its corresponding opposing outlet end of the main housing. In use, the engagement ends will protrude from the main housing upon movement of the first ends of the track members away from one another due to the rotation of the drive segment in the first direction. Similarly, upon rotation of the drive segment in the second direction the engagement ends of the lock shafts retract back into the main housing through the opposing outlet ends.

Disposed adjacent the main housing at each of the opposing outlet ends thereof is a shaft retention housing. Each of the shaft retention housings is structured and disposed to receive a corresponding one of the engagement ends of the lock shafts therein, when the engagement ends of the lock shafts protrude through the opposing outlet ends of the main housing. As a result, planar movement of the main housing relative to the shaft retention housings is prevented, and planar movement of the structure closure, as would result during the opening of the structural closure, with which the lock system is installed is prevented.

It is an object of the present invention is to provide a substantially secure and self-contained lock system.

Still another object of the present invention is to provide an improved lock system having a substantial ease of movement and structured with substantially strong durable material(s).

Yet another object of the present invention is to provide an improved lock system which is not susceptible to prying or facilitated dislodging from its locked position.

Also an object of the present invention is to provide an improved lock system which is capable of securing a structural closure at opposing sides thereof, and which provides for facilitated actuation to achieve appropriate securing and unlocking.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
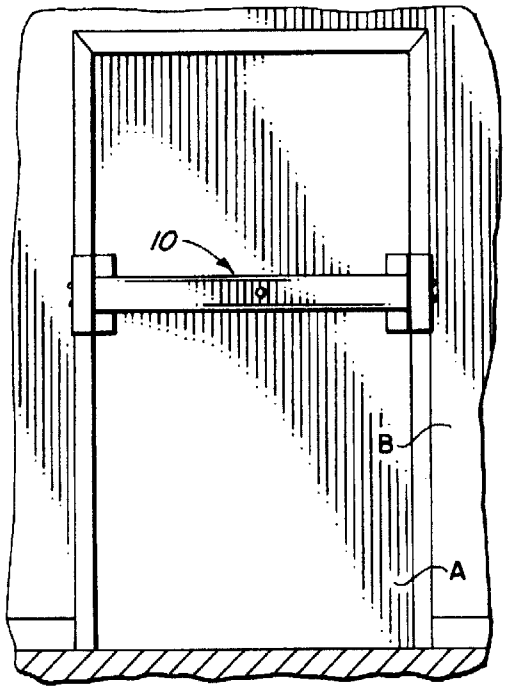
FIG. 1 is front view of the improved lock system of the present invention installed on a structure closure.

Shown throughout the drawings, the present invention is directed towards an improved lock system, generally indicated as 10. The lock system 10 is preferably to be utilized to maintain a structure closure "A", such as a door or window, in a secure, closed orientation.

Included in the improved lock system 10 is a main housing 20. The main housing 20 preferably has a generally elongate, tubular type configuration and is constructed of a solid steel or like substantially strong, rigid and impact resistant material. As such, the main housing 20 includes a surrounding wall structure 21, which defines a main body of the main housing 20, an open interior 22, and opposing outlet ends 24 and 26. Further, in the preferred embodiment illustrated in the drawings, the main housing 20 will also include opposing end segments 23 and 25 disposed in adjacent abutting relation with the surrounding wall structure 21 and including the opposing outlet ends 24 and 26 of the main housing 20 therein. The opposing end segments 23 and 25, although not necessary, are preferably included with the main housing 10 and can be integrally or separately formed with the surrounding wall structure 21. In particular, the outwardly extending configuration of the opposing end segments 23 and 25 substantially facilitates securing of the lock system 10 to the structure closure "A", and further increase the strength of the engagement of the main housing 20 of the improved lock system 10 with the structure closure "A".

Contained within the open interior 22 of the main housing 20 are a pair of opposing track members 30 and 30'. Each of the opposing track members 30 and 30' includes a first end 31 and 31', a second end 32 and 32' and a plurality of teeth 35 along an interior surface 33 and 33' thereof. Further, in the preferred embodiment the opposing track members 30 and 30' will have a generally L-shaped configuration such that the first ends 31 and 31' are disposed substantially perpendicular to a surface plane of the plurality of teeth 35 along the interior surfaces 33 and 33'. Within the open interior 22 of the main housing 20, the opposing track member 30 and 30' are disposed in spaced, confronting relation from one another such that the interior surfaces 33 and 33' confront one another, and such that the first ends 31 and 31' of each of the track members 30 and 30' extend towards a corresponding one of the opposing outlet ends 26 and 24, respectively, of the main housing 20. Additionally, the track members 30 and 30' are retained within the main housing 20 so as to be able to freely slide in a lateral direction within the open interior 22 of the main housing 20.

Figure 2:
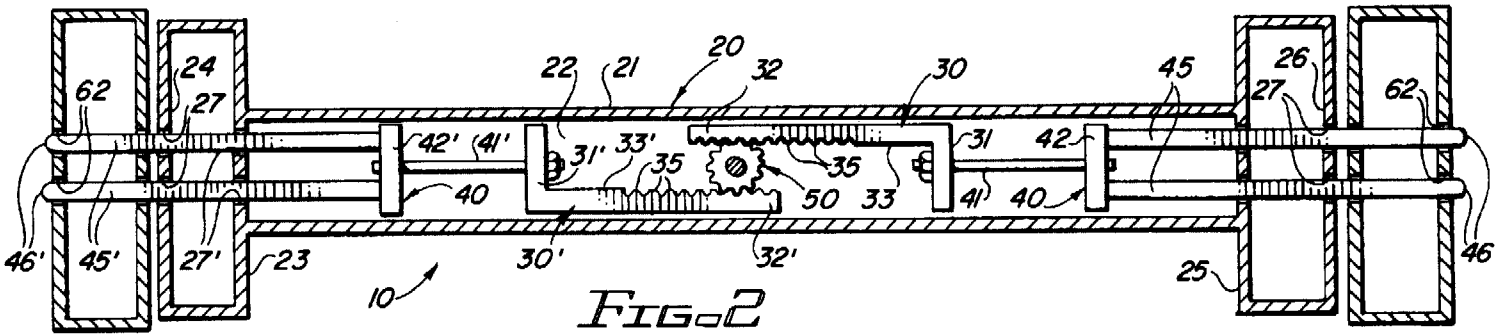
FIG. 2 is a cross-sectional view of a preferred embodiment of the improved lock system of the present invention.

Positioned between the confronting interior surfaces 33 and 33' of the track members 30 and 30' is a drive member 50. This drive member 50 includes primarily a drive segment 52 and at least one actuator segment 54. Specifically, with regard to the drive segment 52, it will include a plurality of drive teeth 53 disposed about a perimeter thereof. The drive teeth 53 on the drive segment 52 are structured to engage the teeth 35 on both interior surfaces 33 and 33' of the track members 30 and 30' simultaneously. As illustrated in FIG. 2A, a number of drive teeth 53 on a top side of the drive segment 52 engage the teeth 35 on one of the track members 30 while the drive teeth 53 on an opposite, bottom side of the drive segment 52 engage the teeth 35 on the other, confronting track member 30'. As such, the drive segment 52 is disposed such that rotation thereof will result in corresponding lateral movement of both of the track members 30 and 30'. Due to the interlocking positioning, upon rotation of the drive segment 52 in a first direction, clockwise in the drawings, the driving engagement of the various teeth will result in the lateral movement of the track members 30 and 30' in a direction such that the first ends 31 and 31' of the track members 30 and 30' move away from one another and towards their corresponding opposing outlet ends 26 and 24, respectively, of the main housing 20. Conversely, upon rotation of the drive segment 52 in a second direction, counter-clockwise in the drawings, the track members 30 and 30' move laterally such that the first ends 31 and 31' thereof move towards one another and away from their corresponding opposing outlet ends 26 and 24 of the main housing 20.

Figure 4:
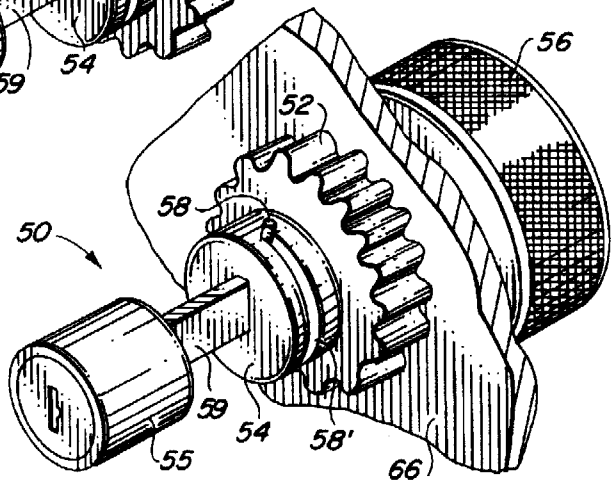
FIG. 4 is a perspective view of yet another embodiment of the drive member of the improved lock system of the present invention.
Figure 3:
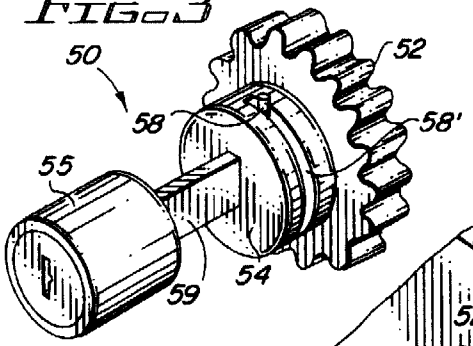
FIG. 3 is a perspective view of an embodiment of the drive member of the improved lock system of the present invention.
Figure 4A:
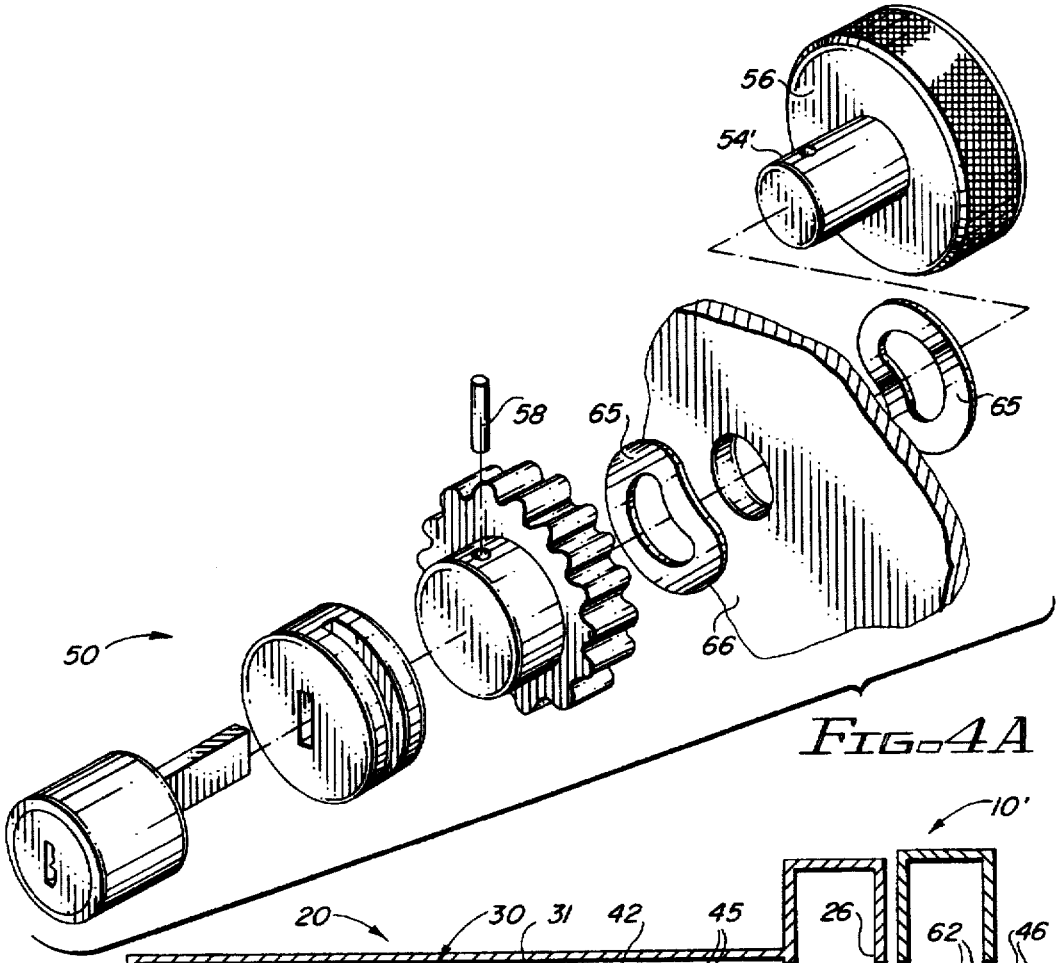
FIG. 4A is an exploded view of the embodiment of FIG. 4.

Turning to FIGS. 3, 4 and 4A, the drive segment 52 of the drive member 50 is structured to rotate in the corresponding direction as a result of the rotation of an actuator segment 54 of the drive member 50. In a first, preferred embodiment, illustrated in FIGS. 4 and 4A, a pair of opposing actuator segments 54 and 54' are included and drivingly interconnected with the drive segment 52. In this embodiment, one of the actuator segments would only protrude slightly from the surrounding wall structure 21 of the main housing 20 and the other actuator segment would protrude substantially so as to be able to extend through the structure closure "A" and be accessible from an opposite side, relative to the placement of the lock system 10, of the structure closure "A". Further, the actuator segments can be connected to a variety of actuation means such as a key lock 55 or an actuator handle 56. In this regard, any of a variety of configurations is effective depending upon the specific needs of the lock system 10. For example, key locks 55 could be connected with both actuator segments 54 and 54', or actuator handles 56 in addition to key locks 55 can be included on one or both actuator segments 54 and 54'. In the embodiment wherein a key lock 55 is connected with one actuator segment and an actuator handle 56 is disposed on an opposite actuator segment, it is preferable that they be able to rotate relative to one another. For example, in the preferred embodiment detailed in FIGS. 4 and 4A, the actuator handle 56 will be integrally formed with the actuator segment 54', which extends through a mount plate 66 into axial secured interconnection with the drive segment 52 of the drive member 50, such that rotation of the actuator handle 56 directly corresponds rotation of the drive segment. Extending from an opposite side of the drive segment 52 is a linkage end 57 having a lock pin 58 extending radially therefrom. This lock pin 58 is structured to extend through a drive slot 58' formed in a drive cylinder 54, which functions as the actuator segment and is structured to extend into fitted engagement over the linkage end 57, and is rotatingly connected via a drive rod 59 with the key lock 55. The drive slot 58' will preferably be sufficiently elongate such that rotation of the actuator handle 56 so as to unlock the lock assembly 10 will not result in engagement of the lock pin 58 with an end of the drive slot 58'. Conversely, when the key lock 55 is actuated, the drive slot 58' rotates to engage the lock pin 58 to result in corresponding rotation of the linkage end 57 and accordingly the drive segment secured thereto. Additionally, as is seen in FIG. 4A, tension means in the form of a pair of curved washers 65 are preferably disposed between the drive segment 52 and the mount plate 66, and between the actuator handle 56 and the mount plate 66. These washers 65 function to provide some tension against the rotation of the drive segment 52 as will be described subsequently.

In an alternative embodiment of the drive member 50', illustrated in FIG. 3, only one actuator segment 54 is included. As with the previous embodiment, that actuator segment 54 can include either a key lock 55, actuator handle 56, or combination of both, as necessary. This second embodiment of the drive member 50' is specially useful in circumstances where the main housing 20 is mounted on an exterior surface of the structural closure "A" and opening and securing from only one side is necessary.

Extending from the first end 31 and 31' of each of the track members 30 and 30' are lock members 40 and 40'. These lock members 40 and 40' extend away from the track members 30 and 30' and towards the corresponding opposing outlet ends 26 and 24 of the main housing 20. Included in each of the lock members 40 and 40' is at least one but preferably a pair of spaced and aligned lock shafts 45 and 45'. The lock shafts 45 and 45' are preferably rounded solid steel, or a like material, and are substantially rigid and are not easily cut or bent. In the preferred embodiment, as illustrated in the drawings, the lock shafts 45 and 45' will preferably be bolted to intermediary panels 42 and 42' from which extension rods 41 and 41' extend. These extension rods 41 and 41' are structured to be bolted securely to the first ends 31 and 31' of the track members 30 and 30' such that lateral movement of the track members 30 and 30' will result in corresponding lateral movement of the extension rod 41 and 41', and accordingly the lock shafts 45 and 45'.

Each of the lock shafts 45 and 45' includes an engagement end 46 and 46' which is specifically structured to protrude from the main housing 20 upon the rotation of the drive segment 52 in the first direction. Accordingly, the opposing outlet ends 26 and 24 will preferably include sized apertures 27 disposed therein to permit passage of the engagement ends 46 and 46' of the lock shafts 45 and 45' therethrough. Also, in the preferred embodiment illustrated in FIG. 2 wherein the opposing end segments 23 and 25 are included and are secured to, but separate from, the surrounding wall structure 21 of the main housing 20, a second set of apertures 27' will be disposed therebetween. Not only will the second set of apertures 27' facilitate passage of the lock shafts 45 and 45', but they will also provide support for the generally elongate lock shafts 45 and 45'. Along these lines, the apertures 27 and 27' are sized so as to maintain the lock shafts 45 and 45' properly aligned for appropriate parallel, lateral movement thereof.

As previously recited the main housing 20 of the lock system 10 is preferably secured directly to the structural closure "A". This securing, which can be preformed by a series of bolts to an exterior surface of the structural closure "A", can also be integral securing wherein the lock system 10 is formed integrally within the structural closure "A" and as such only the opposing outlets ends 24 and 26 and actuator segments 54 visibly protrude from the structural closure "A". Nevertheless, disposed adjacent the opposing outlet ends 24 and 26 of the main housing 20, either on the surrounding wall "B" about the structural closure "A" or embedded therein, are a pair of shaft retention housings 60 and 60'. The shaft retention housings 60 and 60' are preferably formed of a substantially rigid material construction, such as steel, and are structured to be bolted or otherwise fastened in place adjacent to corresponding ones of the opposing outlet ends 24 and 26 of the main housing 20. In particular, the shaft retention housings 60 and 60' each include side entry apertures 62 therein so as to receive a corresponding one of the engagement ends 46 and 46' of the lock shafts 45 and 45' therein and preferably therethrough. As such, when the first end 31 of the track members 30 are spaced a maximum distance from one another, the lock shafts 45 and 45' will extend through the shaft retention housings 60 and 60' and ensure that no planar movement of the main housing 20 relative to the shaft retention housings 60 and 60' is possible. Accordingly, the structure closure "A" to which the main housing is secured will not be able to move in any planar direction relative to the surrounding wall "B" to which the shaft retention housings 60 and 60' are secured. The improved lock system 10 of the present invention can therefore effectively secure, in a closed position, a standard door structure closure, which hinges open, or a window or garage door type structure closure structure, which slides vertically or horizontally relative to its frame, but nonetheless in a planar direction relative to the positioning of the shaft retention housings 60 and 60' on the surrounding wall "B".

Additionally, so as to prevent tampering, the main housing 20 and shaft retention housings 60 and 60', all of which are preferably formed of a substantially strong and solid material such as steel, will preferably be coated with a thick covering paint or metallic type exterior coat. As a result, this will substantially conceal and prevent access to the interior of the main housing 20, and therefore tampering with the improved lock system 10 of the present invention.

Figure 6:
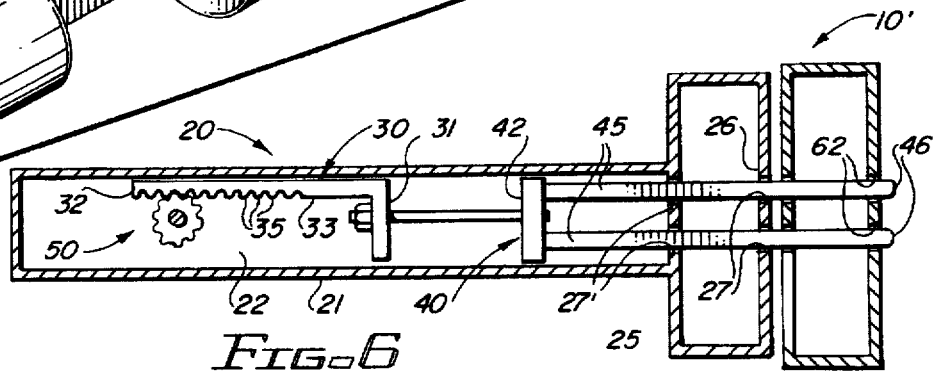
FIG. 6 is a cross-sectional view of an additional embodiment of the improved lock system of the present invention.
Figure 5:
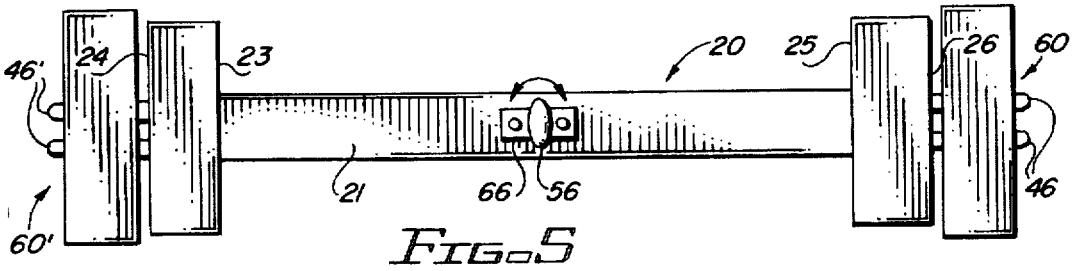
FIG. 5 is a rear view of an alternative embodiment of the improved lock system of the present invention.

In yet another embodiment illustrated in FIG. 6, the lock assembly 10' includes only one track member 30, and accordingly only one lock member 40 extending therefrom towards an outlet end 27 of the main housing 20. This embodiment is especially useful in circumstances where the structure closure A is substantially wide and the positioning of one or more of the lock assemblies 10' at each is beneficial. Also, in some residential or more visible locations, this alternative embodiment is less bulky and provides a more attractive appearance.

Figure 7:
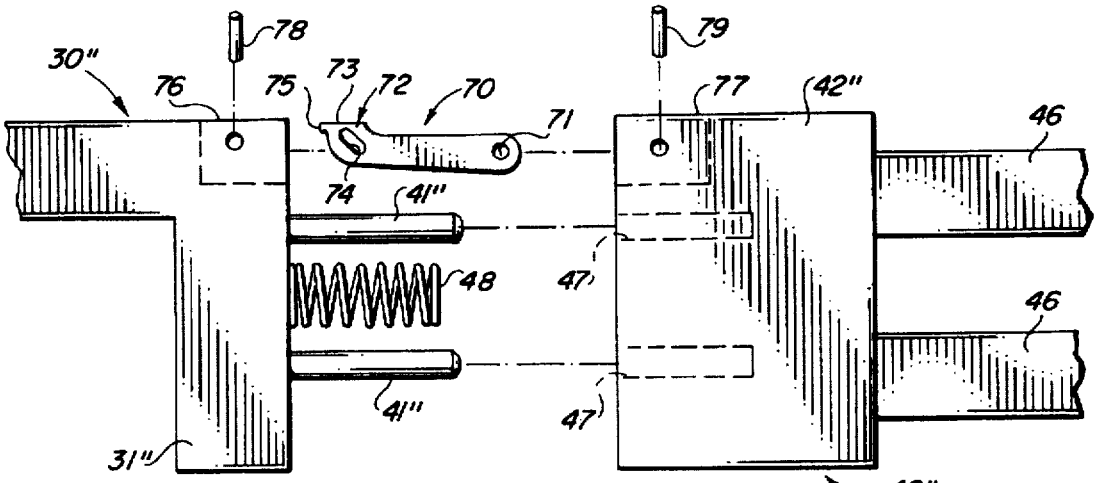
FIG. 7 is an exploded view of the retraction resistance means of the present invention.
Figure 8:
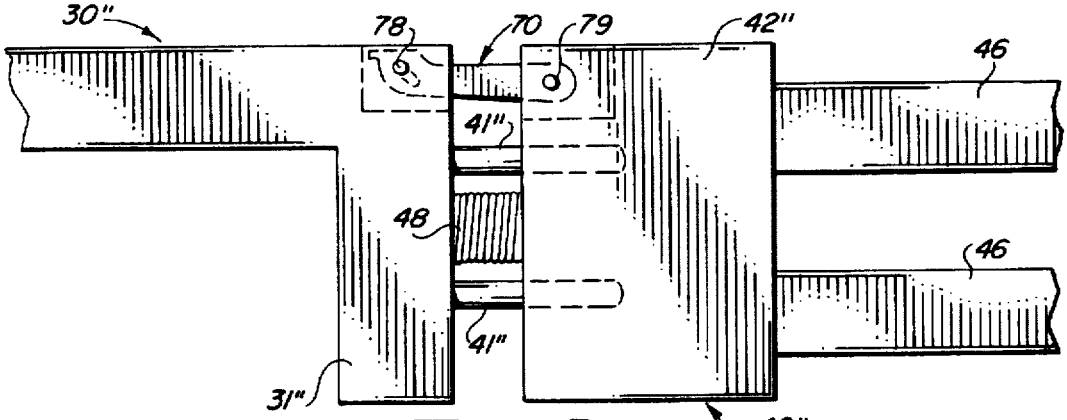
FIG. 8 is an isolated side view of the retraction resistance means of the present invention in a normal state.
Figure 9:
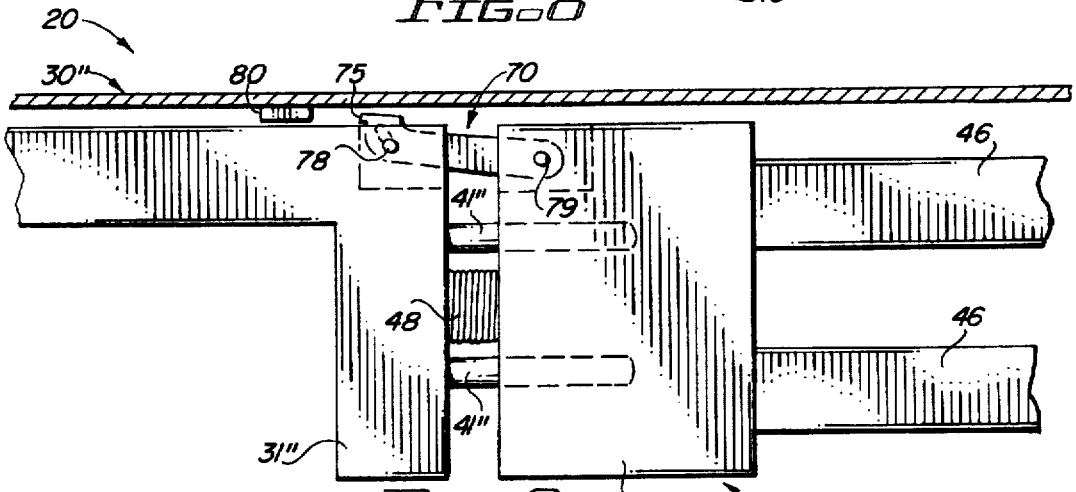
FIG. 9 is an isolated side view of the retraction resistance means of the present invention in a compressed, retraction prevention state.

Finally, in either of the previously recited embodiments, an alternative, increased security, retraction resistance means provide the interconnection between the lock member 40" and track member 30" may be included. In this embodiment, illustrated in FIGS. 7, 8, and 9, the intermediary panel 42" of the lock member 40" includes at lest one, but preferably a pair of axial bores 47 formed therein. The axial bores 47 are structured to receive a pair of extension rods 41" which protrude from the first end 31" of the track member 30". Furthermore, a biasing spring 48 is disposed between the track member 30" and the lock member 40" so as to tend to push the members 30" and 40" apart from one another. The track member 30" and lock member 40" are maintained secured with one another by a connector element 70. The connector element 70 includes an aperture 71 at one end and a slot 72 at an opposite end and is structured to be partially inserted into an opening 76 in the first end 31" of the track member 30" such that a pin 78 may extend through the first end 31" and through the slot 72 of the connector for effective pivotal interconnection. Similarly, the intermediary panel 42" of the lock member 40" includes an opening 77 wherein the connector element 70 is partially inserted such that a pin 79 may extend through the intermediary panel 42" and the aperture 71 for effective pivotal interconnection. It is therefore seen that the biasing force of the spring 48, which tends to separate the track and lock members 30" and 40", does not totally separate the elements as restricted by the connector element 70. Further, in a normal, at rest orientation, the pin 78 tends to remain in a front end 73 of the slot 72 in the connector element 70. If, however, someone attempts to disengage the lock member 40" by pushing it inwardly, the spring 48 compresses and the pin 78 slides to the rear end 74 of the slot 72 in the connector element. When this occurs, a lip 75 formed in the connector is caused to protrude from the first end 31" of the track member 30", as illustrated in FIG. 9, so that it will engage a stopper 80 formed in the surrounding wall structure 21 and prevent inward movement. As previously recited, the curved washers 65 function to increase a rotating tension on the drive segment 52. In particular, the washers 66, which tend to outwardly bias the drive segment 52 and handle segment 56 are structured to provide enough resistance to rotation such that if the lock member 40" is pushed inwardly, the strength of the spring 48 will be overcome before the washers 65 permit rotation of the drive segment 52.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the application has been described:

What is claimed is:

1. A lock system comprising:

a main housing, said main housing including a surrounding wall structure, an open interior, and opposing outlet ends, a pair of opposing track members, each of said track members including a first end, a second end, and a plurality of teeth along an interior surface thereof, said pair of opposing track members being disposed in spaced, confronting relation from one another in said open interior of said main housing such that said interior surface, and accordingly said plurality of teeth along said interior surface, of each of said track members confront one another, and such that said first end of each of said track members extend towards a corresponding one of said opposing outlet ends of said main housing, a drive member, said drive member including a drive segment disposed in said main housing between said confronting interior surfaces of said track members, and at least one actuator means protruding from said main housing through said surrounding wall structure of said main housing and structured to turn said drive segment upon actuation thereof, said drive segment including a plurality of drive teeth about a perimeter thereof, said drive teeth being structured to engage said teeth on said confronting interior surfaces of said track members such that upon rotation of said drive segment in a first direction said first ends of said track members move away from one another and towards said corresponding one of said opposing outlet ends of said main housing, and upon rotation of said drive segment in a second direction said first ends of said track members move towards one another and away from said corresponding one of said opposing outlet ends of said main housing, a lock member extending from said first end of each of said track members towards said corresponding one of said opposing outlet ends of said main housing, each of said lock members including at least one lock shaft having an engagement end structured to protrude through said corresponding one of said opposing outlet ends of said main housing upon movement of said first end of each of said track members away from one another due to rotation of said drive segment in said first direction, a shaft retention housing disposed adjacent said main housing at each of said opposing outlet ends thereof, each of said shaft retention housings being structured to receive a corresponding one of said engagement ends of said lock shafts therein, upon said engagement ends protruding through said opposing outlet ends of said main housing, so as to prevent planar movement of said main housing relative to said shaft retention housing, said lock members and said track members being interconnected with one another by retraction resistance means structured and disposed to prevent inward, retracting movement of said lock members and said track members upon inward pushing of said lock members, said retraction resistance means comprising:

at least one extension rod and corresponding axial bore disposed on said track members and said lock members for sliding, aligned interconnection, a biasing spring disposed between each of said lock members and said track members and tending to urge said lock members and said track members apart from one another, a connector element disposed in interlocking retaining connector between each of said lock members and said track members, said connector element including an aperture disposed at one end thereof and structured to receive a lock pin therethrough for pivotal connection of said one end of said connection element with said lock members, said connector element including a slot disposed at an opposite end thereof and structured to receive a lock pin therethrough for pivotal connection of said opposite end of said connector elements with said track members, said connector element including a lip formed at said opposite end thereof, and said pin in said slot being structured and disposed to slide within said slot and pivot said connector element, such that said lip engages a stopper and inward movement of said lock members and track members is prevented, upon said lock members being pushed towards said track members.

2. A lock system as recited in claim 1 wherein said opposing track members are generally L-shaped and said first end is generally perpendicular from said plurality of teeth along said interior surface thereof.

3. A lock system as recited in claim 1 wherein each of said lock members includes a pair of spaced lock shafts.

4. A lock system as recited in claim 1 wherein said actuator means includes an actuator segment connected with a keyed lock.

5. A lock system as recited in claim 1 wherein said actuator means includes an actuator segment connected with an actuator handle disposed exterior of said main housing.

6. A lock system as recited in claim 1 wherein said drive member includes two of said actuator means protruding from opposite sides of said main housing through said surrounding wall structure of said main housing and structured to turn said drive segment upon actuation thereof.

7. A lock system as recited in claim 6 wherein at least one of said actuator means includes an actuator segment connected with a keyed lock.

8. A lock system as recited in claim 6 wherein at least one of said actuator means includes an actuator segment connected with a handle disposed exterior of said main housing.

9. A lock system as recited in claim 6 wherein said drive segment includes at least one linkage end whereover a drive cylinder of one of said actuator segments is rotatably disposed, said drive cylinder including a drive slot formed therein wherethrough a lock pin extending radially from said linkage end passes such that only upon rotation of said actuator segment, and accordingly said drive cylinder, until an end of said drive slot engages said lock pin will said drive segment rotate.

10. A lock system as recited in claim 1 wherein said main housing is structured to be disposed on a structure closure and said shaft retention housings,are disposed on a perimeter wall surface about the structure closure such that upon said corresponding one of said engagement ends of said lock shafts being received in said shaft retention housings, said structure closure cannot be opened.

11. A lock system as recited in claim 1 wherein said drive segment includes at least one linkage end whereover a drive cylinder of said actuator means is rotatably disposed, said drive cylinder including a drive slot formed therein and structured to receive a lock pin, extending radially from said linkage end, therethrough, such that only upon rotation of said drive cylinder until an end of said drive slot engages said lock pin, will said drive segment rotate.

12. A lock system as recited in claim 1 wherein said drive member includes tension means structured and disposed to resist rotation of said drive segment a greater amount than said spring resists inward movement of said lock members towards said track members.

* * * * *